US011835260B1

(12) United States Patent
Crittenden

(10) Patent No.: US 11,835,260 B1
(45) Date of Patent: Dec. 5, 2023

(54) INTERIOR VENTILATOR DOOR FOR PURIFYING AIR AND A METHOD OF EMPLOYING THE DOOR TO PURIFY AIR IN A STRUCTURE

(71) Applicant: Jerry G. Crittenden, Phoenix, AZ (US)

(72) Inventor: Jerry G. Crittenden, Phoenix, AZ (US)

( * ) Notice: Subject to any disclaimer, the term of this patent is extended or adjusted under 35 U.S.C. 154(b) by 0 days.

(21) Appl. No.: 17/803,342

(22) Filed: May 18, 2022

Related U.S. Application Data

(63) Continuation-in-part of application No. 16/873,707, filed on Jun. 8, 2020, and a continuation-in-part of application No. 16/873,156, filed on Feb. 14, 2020, now Pat. No. 11,215,006.

(51) Int. Cl.
*F24F 8/108* (2021.01)
*F24F 3/16* (2021.01)
*F24F 13/20* (2006.01)

(52) U.S. Cl.
CPC ..... *F24F 8/108* (2021.01); *F24F 3/16* (2013.01); *F24F 13/20* (2013.01); *F24F 2013/205* (2013.01)

(58) Field of Classification Search
CPC ..... E06B 7/02; E06B 2007/023; F24F 7/007; F24F 7/065; F24F 13/085; F24F 13/10; F24F 13/28; F24F 8/108; F24F 3/16; F24F 13/20; F24F 2013/205; B01D 46/00488; B01D 46/12; B01D 46/62; B01D 2273/30; B01D 2279/35
USPC ..... 454/195, 211, 265, 277
See application file for complete search history.

(56) References Cited

U.S. PATENT DOCUMENTS

| | | | | |
|---|---|---|---|---|
| 3,094,058 | A * | 6/1963 | O'Brien, Jr. | F24F 13/12 454/211 |
| 4,957,038 | A * | 9/1990 | Hamilton | E06B 1/003 454/195 |
| 5,120,273 | A * | 6/1992 | Lin | F24F 13/18 454/212 |
| 8,246,703 | B2 * | 8/2012 | Bordin | F24F 13/28 454/238 |
| 10,012,408 | B1 * | 7/2018 | Crittenden | E06B 7/04 |
| 2007/0042703 | A1 * | 2/2007 | Lee | E06B 7/02 454/213 |

(Continued)

*Primary Examiner* — Avinash A Savani
*Assistant Examiner* — Dana K Tighe
(74) *Attorney, Agent, or Firm* — H. Gordon Shields

(57) ABSTRACT

A door includes an air purifying assembly is secured to the door for filtering air flowing through the door. The air purifying assembly includes an outer housing, a fan housing in the outer housing, a filter housing secured to the outer housing, a filter in the filter housing, and a fan in the fan housing for providing a flow of air through the fan, fan housing, and out of the outer housing and outwardly through the door for purifying air. A plurality of doors in a structure, and an air purifying assembly in each door in the structure may purify the air in the structure. With a forced air unit for the structure, the air from the plurality of doors is discharged to the return air space and recirculating the purified air from rooms which include the doors having air purifying assemblies. Both an air purifying door structure and a method of purifying air in a structure utilizing the air purifying doors are included as claims.

19 Claims, 10 Drawing Sheets

(56) References Cited

U.S. PATENT DOCUMENTS

2010/0197214 A1* 8/2010 Geremia, Sr. ..... F24F 13/18
454/251

* cited by examiner

INTERIOR VENTILATOR DOOR FOR PURIFYING AIR AND A METHOD OF EMPLOYING THE DOOR TO PURIFY AIR IN A STRUCTURE

CROSS REFERENCE TO RELATED APPLICATIONS

This application is a continuation in part of application Ser. No. 16/873,707, filed 06/08/2020, which was a continuation in part of application Ser. No. 16,873,156, filed Feb. 14, 2020, now U.S. Pat. No. 11,215,006, dated Jan. 4, 2022,

STATEMENT REGARDING FEDERALLY SPONSORED RESEARCH OR DEVELOPMENT

Not Applicable

BACKGROUND OF THE INVENTION

Field of the Invention

This invention pertains to an interior ventilator door, including a filter, and a fan, for purifying air within a room. The filtered air is discharged through the door, and into a common area to which a plurality of doors may discharge filtered air, or to a return air area for forced air system. The forced air system is for a structure to which the door, or a plurality of like doors, is secured.

Description of the Prior Art

Prior art shows exterior doors for bringing fresh outside air into structures. For example, U.S. Pat. Nos. 10,012,408 and 10,337,238 disclose bringing fresh air into structures by providing ducts extending vertically in the doors.

The above noted Exterior Door '006 receives and filters outside fresh air and delivers the fresh air into a structure, such as a house, to which the door is secured. Bringing fresh outside air into a structure prior to the advent of the above noted exterior doors was either by opening a window or opening an exterior door. Those were the most logical manner in which outdoor air was introduced into a structure, and were easy solutions.

The problem with such early solutions prior to the noted patents was simply a matter of opening and closing a window or windows and then shutting them again. The simple solutions also become acute when the structure, typically a home, was left without anyone being present. An open window is an invitation to insects and to burglars. Moreover, open windows and a vacant home in a rain storm invites water damage of from simple wetting to severe wetting.

With the problem of bringing outside air into a structure through and filtering the air door solved, the next general problem to be solved is to provide structure that allows easy changing of the filters.

Solutions to that issue is shown in the above noted patents and the immediate parent application of the present application. The next step is to provide structure for inside doors. Then, inside doors and filters may be used for purifying an entire structure by a plurality of inside doors having filters. The outside doors have a greater thickness than inside doors. Inside doors thus have less room for filters than outside doors. A solution then is to provide more inside doors for a structure.

The ventilator door of the present invention provides a practical solution to purifying inside air by filtering air from a room to a hall of a structure. With a structure having a plurality of rooms, each of which rooms have a filter in each door, and venting the filtered air to a common area, all of the air circulating in the structure will be filtered, thus purifying the air circulating in the structure. Each door includes a fan for providing the air flow through the door from a room. A forced air system fan or blower simply increases the air flow through the door filter if both the door fan and the system fan or blower are on at the same time. The filter in a door as illustrated for the present invention is preferably a HEPA filter, or a MERVE 17 filter, for maximum filtering capability. Any appropriate or desired filter may be used, but a HEPA filter is preferred. It will be noted, that, like the fans in the other doors, the fan structure extends the full width of the door between the stiles of the door frame.

SUMMARY

The invention described and claimed herein comprises an interior ventilator door for filtering air flowing from a room into a hall or the like of a structure to which the door is secured. The door includes a fan for providing a flow of air through a filter from a room and discharging the filtered air to a hall or the like common area or return air area.

The employment of a plurality of such doors in a structure such as a home or an apartment, comprises a system for purifying an entire structure. Interior doors are typically hollow core doors that have a thickness less than exterior doors. Accordingly, only a single filter is shown in the drawings of the present invention, rather that a plurality of filters shown in the drawings of the parent exterior doors herein.

Among the objects of the present invention include the following:

To provide and new and useful ventilator door;

To provide a new and useful interior ventilator door;

To provide a new and useful interior door for filtering inside air from a room through filter to a hall of a structure;

To provide a new and useful interior ventilator door through which air flows from a room;

To provide a new and useful ventilator door having a fan for providing a flow of filtered air through an interior door;

To provide a new and useful ventilator door having a fan and a filter for providing a flow of filtered air from a room to a hall.

To provide a new and useful assembly through which filtered air flows through a plurality of doors each having a fan and a filter for providing purified air for a structure;

To providing a new and useful assembly of ventilator doors each door of which includes at least a single filter and a fan for providing a flow of filtered air from the plurality of doors to a common portion of a structure to which the plurality of doors is secured to purify the air in the structure.

To provide a new and useful ventilator door for a structure having a common area such as a hall connected to an air circulating system, which system provides a flow of air to a room in the structure to which the door is secured and which door includes a fan and at least a single filter for filtering the flow of air through the door from the room;

To provide a new and useful ventilator door having a filter for filtering a flow of air through the door from a room to a common space in a structure;

To provide a new and useful ventilator door for providing a flow of filtered air through the door from a room which receives a flow of air from a forced air system and which door includes a filter and a fan for providing a flow of filtered air from the room to a common return air space, from which common return air space the the forced air system provides a flow of air to the room;

To provide a new and useful method of employing an interior door to purify air in a structure; and To provide a new and useful method of employing a plurality of doors to purify air in a structure;

To provide a new and useful method of purifying air in a structure having a door with a filter for filtering air in a room to which a door is secured;

To provide a new and useful interior ventilator door having a filter for filtering air flowing through the door; and To provide a new and useful method for purifying air in a structure having forced air system and a plurality of doors each having filters for filtering air from a plurality of rooms.

The relative scale for the Figures is adjusted or varied as required for clarity.

DESCRIPTION OF THE PREFERRED EMBODIMENT

Figure 1:
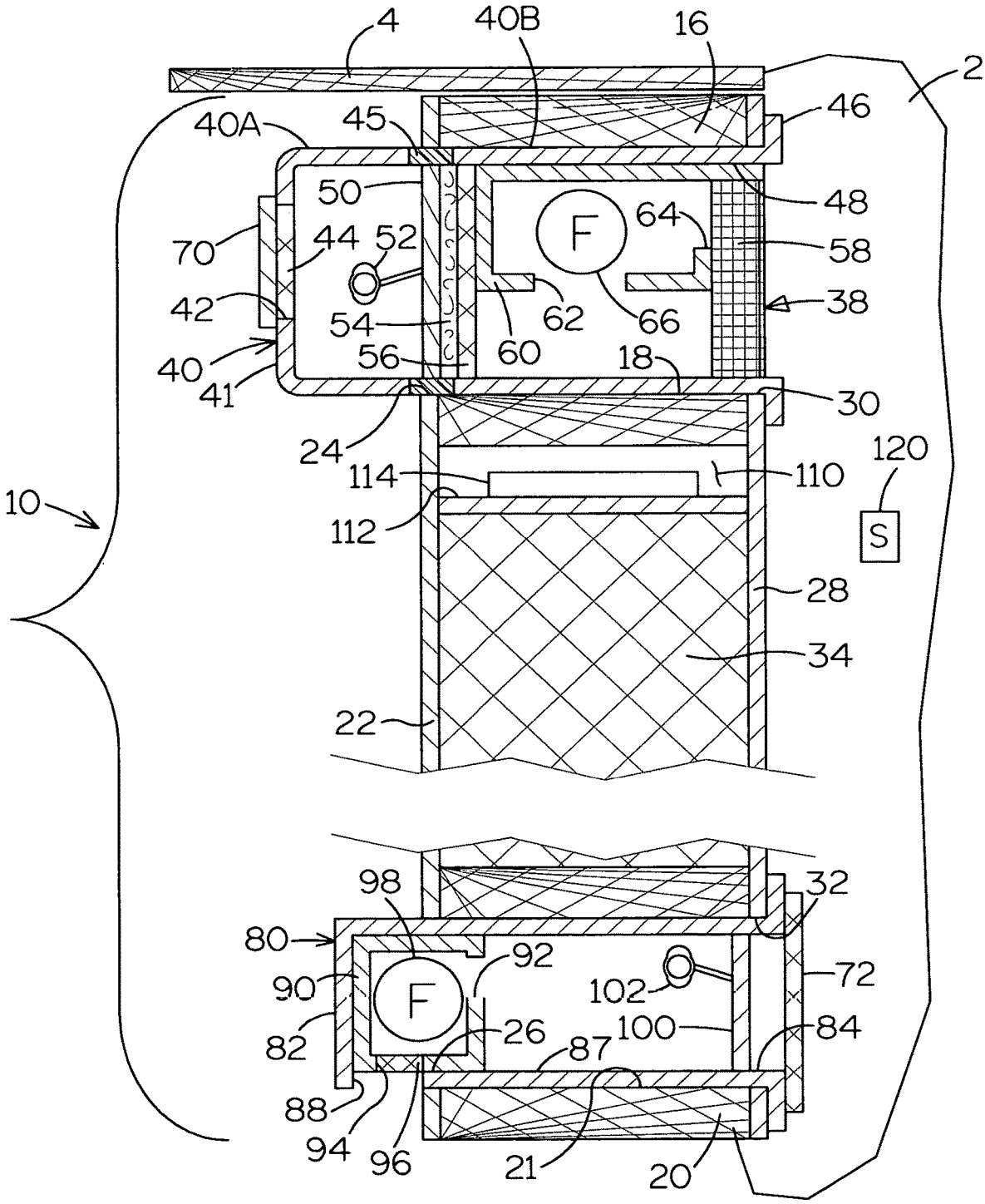
FIG. 1 is a schematic side view in partial section of an exterior ventilator door 10.
Figure 3:
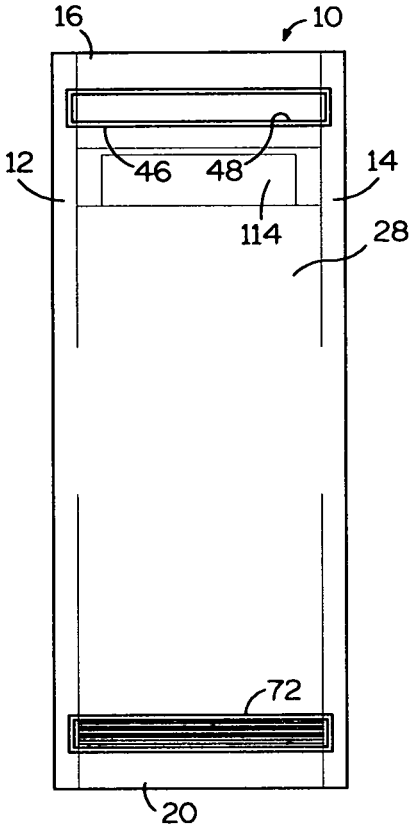
FIG. 3 is a rear view of the door 10 of FIG. 1.

FIG. 1 is a schematic side view in partial section through an exterior door 10. FIG. 3 is a rear, or inside, view of the door 10 of FIG. 1. For the following discussion reference may be made to both FIGS. 1 and 3.

The door 10 is situated in a structure 2. The structure 2 includes an overhang or jamb header 4 under which a portion of the door 10 is disposed.

The terms "outside" or "exterior" and "inside" generally pertain to the relationship of the door to the structure to which the door is secured. That is, the "outside" of the door 10 refers to the face of the door through which fresh air enters through door. The "inside" of the door 10 refers to the face of the door from which fresh outside air enters the structure to which the door is secured. The term "ventilator" refers to a type of door through which air flows, generally to provide fresh air to the inside of a structure. The door 10 is an exterior "ventilator" door for both home and apartment structures.

The door 10 is schematically illustrated as a solid core door of conventional stile and rail frame construction. The scale has been exaggerated so as to clearly show elements of the structure. The door 10 has a frame including a pair of spaced apart stiles 12 and 14 appropriately secured to an upper or top rail 16 and a bottom or lower rail 20. See FIG. 2, with the stiles and rails shown in dotted line. It will be shown best in FIG. 1 that the top rail 16 extends vertically longer or taller than in an "ordinary" door to accommodate elements through which exterior air flows into the structure 2. The top rail 16 includes an opening 18 to accommodate the exterior air flow elements. This will be discussed in detail below and is shown in both FIGS. 1 and 2.

An outside skin 22 and an inside skin 28 are appropriately secured to the stile and rail frame.

The outside skin 22 includes an upper intake opening 24 and a lower exhaust or outflow opening 26. The inside skin 28 includes corresponding upper opening 30 and a lower vent or exhaust opening 32. The openings 24, 26, and 30, 32, are generally parallel to each other.

Within the door 10 is a solid core, preferably insulation, 34.

Secured to the door 10 and extending through the opening 18 in the top rail 16 is a ventilator assembly 38. The ventilator assembly 38 comprises a horizontally extending duct through which outside air is brought into the structure 2.

The ventilator assembly 38 includes a housing 40, which is an upper housing. The housing 40 includes an outside end wall 41 which extends outwardly from the planar portion of the door 10 as defined by the outer skin 22. There is a generally open end to the housing 40, remote from the outside wall 41, and generally parallel to the end wall 41, comprising an opening 48 and a vertically extending inside flange 46. The outside air flows into the structure 2 through the opening 48.

The upper housing 40 extends outwardly of the structure 2 and beneath the overhang or header 4. For apartment structures where the "outside" door opens in a corridor, there will of course be no overhang structure.

An opening 42 in the end wall 41 exterior or outer portion of the housing 40 is covered by a screen 44. At the opposite end of the housing 40, the flange 46 is disposed against the inside skin 28 about the opening 30 in the skin 28. The housing 40 is secured to the door 10 through the flange 46 and through the skin 28 and into the top rail 16 by appropriate fasteners.

Exterior or outside air flows into the housing 40 through the screen 44. The flow of outside air is controlled by a damper 50. The damper 50 is moved in response to an actuator 52. Air passes preferably through a pair of filters 54 and 56. The filter 54 is preferably a charcoal filter, and the filter 56 is preferably a HEPA filter or a MERVE 13 or higher filter.

Adjacent to the filter 56 is a fan housing 60. The fan housing 60 includes a lower opening 62 through which fresh outside air flows into the fan housing and to a fan 66. The flow of air produced by the fan 66 flows outwardly from the fan housing 60 through an upper fan housing discharge opening 64.

Air moves through the filters 54 and 56 and through the opening 62 in response to the fan 66. From the fan 66 air flows through the opening 64 and through a heat sink 58 and outwardly from the door and into the structure 2 through the opening 48 in the upper housing 40. The heat sink 58 is preferably an aluminum honeycomb heat sink and is disposed in the opening 48 in the housing 40. Air flows through the heat sink 58 in the opening 48 into the structure 2.

In addition to the heat sink function, the aluminum honeycomb heat sink 58 also provides a sound dampening function. The heat sink 58 is in heat transfer contact with the housing 40 and with the fan housing 60, both of which are heat conductive.

For exterior doors, exposure to the sun may result in excessive heat gain for the housing 40 transmitted to the heat sink 58 and thus heated air flowing into the structure 2. Accordingly, a thermal barrier 45 may be inserted to separate the housing 40 into an outside portion 40A and an inside portion 40B. Such a thermal barrier is accomplished by material which does not conduct heat and is inserted between the two portions 40A and 40B of the housing 40.

The purpose of the thermal barrier 45 is to thermally isolate the incoming air flow from the heated portion 40A of the housing 40. Or, in other words, to thermally isolate the inside portion 40B of the housing 40 from the heated portion 40A so as to prevent the incoming outside air from being heated from the housing portion 40A. Thus, the incoming outside air flow is cooled, or heated, as it flows through the heat sink 58 is accordance with the conditioned inside air.

The thermal barrier 45 is shown as plastic material, but any appropriate material that blocks of limits thermal conductivity may be used. Moreover, an air gap, with appropriate connective elements may also be used. Such arrangement is shown in FIG. 3

Figure 2:
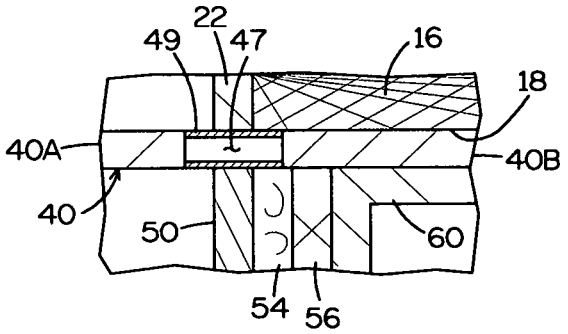
FIG. 2 is an enlarged fragmentary view in partial section of an alternate embodiment of structure of FIG. 1.

FIG. 2 is an enlarged view in partial section of an air gap thermal barrier for use the door 1, an alternate to the solid thermal barrier shown in FIG. 1. FIG. 2 is enlarged to show the relation of the various elements involved. A portion of the outside housing 40A is shown extending through the opening 18 in the top rail 16.

A portion of the outside skin 22 is shown, with the opening 24 through which the housing 40 and its outside portion 40A extends. The upper portions of the damper 50 and the filters 54 and 56 also shown.

An air gap 47 is shown between the portions 40A and 40B is shown providing a thermal barrier between the outside and inside portions 40A and 40B, thus insulating the air flow from the heat of the outside portion 40A of the housing 40. The air gap 47 also provides a thermal barrier for the fan housing 60.

The air gap 47 is shown with appropriate elements 49 structurally connecting the housing portions 40A and 40B. The elements 49 are preferably also thermally non-conductive but structurally connective.

Like the top rail 16, the lower rail 20 is vertically longer than a typical rail to provide for an opening 21 to receive a lower housing 80.

At the lower portion of the door 10 are the openings 26 and 32 in the skins 22 and 28, respectively, and the lower housing 80 extends through the openings 26 and 32 in the skins 22 and 28, respectively, and through the opening 21 in the bottom rail 20.

The housing 80 is of a generally hexagonal configuration, with five sides or walls, including an outer end wall 82. The outer or outside end wall 82 is disposed outwardly from the planar portion of the door 10 as defined by the skins 22 and 28, similarly tote outer end wall 41 of the upper housing 40.

At the opposite end of the housing 80, which is generally open, remote from the end wall 82, there is an opening 84 for receiving a flow of stale or exhaust air from the structure 2.

An outwardly extending flange 86 of the lower housing 80 is disposed against the inside skin 28 about the opening 84. The lower housing 80 is secured to the door 10 through the flange 86 by appropriate fasteners.

There is an opening 88 in the bottom wall 87 through which air flows out of the lower housing 80.

A grill 70 coves the opening 42 in the end wall 42 of the upper housing 40. A grill 72 covers the opening 84 in the lower housing 80.

A fan housing 90 is disposed in the lower housing 80. The fan housing 90 includes an opening 92 for receiving stale or exhaust air from the structure 2 through the grill 72. The flow of air through the grill 72 and the opening 84 is controlled by a damper 100. The damper 100 is controlled by an actuator 102.

The fan housing 90 includes a bottom opening 94. A screen 96 is disposed in the opening 94. Air flow through the housing 80 and the fan housing 90 is provided by a fan 98. Thus, stale air is exhausted from the structure 2 by the fan 98 and the housings 80 and 90 according to the position or setting of the damper 100.

In turn, the damper actuators 52 and 102 are controlled by electronic elements located in a housing 114 in a chamber 110. The chamber 110 is beneath the top rail 16 and extends between the stiles 12 and 14. The chamber 110 includes a bottom plate or shelf 112. The compartment 110 extends between the bottom of the top rail 16 and the plate 112. Appropriate electronic elements, including electrical power elements for providing power for the fans 66 and 98, are located in the housing 114 in the compartment 110.

A sensor 120, or a plurality of sensors 120, provide/s input information to the electronics in the housing 114 and is/are located as desired within the structure 2 and within the door 10. The sensor/s 120 is/are schematically illustrated. The use of microprocessors and sensors is well known and understood in contemporary usage for controlling actuators. Also, elements for bringing electrical power into the door 10 are well known and understood and accordingly are not shown.

As shown in FIGS. 1 and 3, the upper housing 40 and the fan 66, and the opening at the flange 48 extend virtually the entire width of the door 10 between the stiles 12 and 14 of the door frame. The lower housing 80 with the fan 98 likewise extend the entire width of the door 10 between the stiles 12 and 14 of the door frame. Air flow into and out of the door 10, and thus the structure 2, is accordingly maximized in a minimum space.

Note that wiring for the fans and the damper actuators are not shown for purposes of clarity. Similarly, hardware for the door 10, well known and understood in the art, is also not shown.

An appropriate power source for the electronics in the housing 114 may be connected inductively, through a hinge, or in any other appropriate manner.

Contemporary electronics allow many functions to be controlled by smart phones, computers, microprocessors, and the like. Accordingly, the electronics in the housing 114 may control, or be controlled, in a variety of ways. Electronics may control not only the fans 66 and 96, but also exhaust fans appropriately located throughout a structure when the fans are actuated, cameras, indoors and outdoors or in a door, or other desired elements. The possibilities are limited only by a users desires and the contemporary technology.

The opposite is also very possible, the electronics in the housing may be remotely controlled by a computer, smart phone, or other remote device. A multitude of sensors may also be installed with the present apparatus, such as temperature sensors not only with the ducts and blowers, but also in other locations in the structure.

While the door 10 brings fresh outside air into a structure, the same volume of air will be evacuated from the structure. Ordinary exhaust fans, such as located in kitchen areas, laundry areas, bathroom areas, or other, may be used for the purpose of exhausting stale air from the structure. The exhaust fans may be controlled as discussed above. However, having the exhaust fan 98 and its associated structure provides the advantage of working in conjunction with the fan 66 and the control elements discussed above.

Contemporary microprocessors may be programmed to perform many different tasks in response to sensed information. For contemporary structures, including homes, many different types of information may be sensed and used to provide predetermined functions, such as moving panels, as in the embodiment of the door 210, controlling the functioning of blowers/fans, and timing cycles relative to the blowers/fans, a heat strip, if so desired, and other functions.

It will be noted that while reference has been made to electronically controlling the damper actuators in response to desired information, it will be obvious that the dampers, and the fans, may be controlled by a timer, or in any other way, including manually, as desired.

While the door 10 is an ideal door structure for replacing existing exterior doors. For new construction, a door structure 140 is preferred, where a ventilator assembly 138 is placed in a transom area immediately above a typical exterior solid core door 130 for a structure 126.

Figure 4:
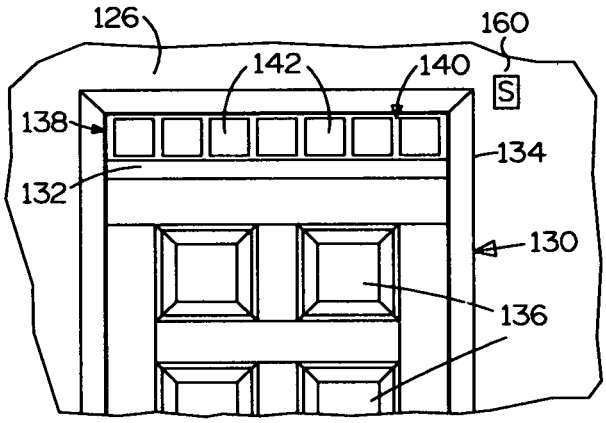
FIG. 4 is a partial front view of an alternate embodiment of the door of FIG. 3.
Figure 5:
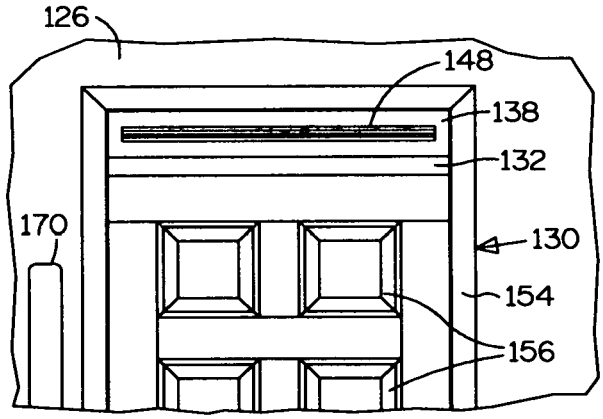
FIG. 5 is a partial rear view of the embodiment of FIG. 4.

FIG. 4 is a schematic representation of the upper exterior portion of the door structure 140. FIG. 5 is a an inside schematic representation of the inside upper portion of the door structure 140. For the following discussion, attention may be directed to both FIGS. 4 and 5.

The door structure 140 includes a typical solid core exterior door 130 located in a structure 126, with a transom area 132 directly above the door 130. An exterior door jamb 134 is disposed about the door 130 and the transom area 132. The ventilator assembly 138 is disposed in the transom area 132. The ventilator assembly 138 is substantially identical to the ventilator assembly 38. The difference is simply that the ventilator assembly 138 is disposed in the transom area 132 above the door 130 and thus extends through a wall of the structure 126. Electrical and electronic elements will also be located in the transom area 132.

Appropriate wiring for the electrical and electronic elements associated with the ventilator assembly 140 may thus be wired as part of the wiring for the structure 126 and disposed in the transom area 132. The use of the transom area eliminates the transfer of electrical power to a ventilator assembly, such as the ventilator assembly 38 of the door 10, through a hinge or as appropriate.

In FIG. 4, the ventilator assembly 138 includes a ventilator assembly housing 140 with a plurality of grills or screens 142 secured to the housing 140. Within the housing 140 are the corresponding elements for the ventilator assembly 38 of FIG. 1, including a damper and damper actuator, at least a single air filter, a fan housing and fan within the fan housing, an opening in the fan housing through which air flows into the fan housing and an outer opening in the fan housing through which air flows out of the fan housing, and a heat sink at the outer opening in the fan housing. The ventilator housing also includes thermal barrier elements.

Decorative panels or elements 136 are also shown on the door 130.

In FIG. 5, an inside view of the door 130 is shown, with an inside or interior door jamb 154 shown. Decorative panels or elements 156 are also shown.

In the transom area 132 the ventilator assembly 138 is shown with a heat sink 148 through which fresh air is blown horizontally into the structure 126.

Like the door 10 of FIGS. 1 and 3, a lower housing may be provided for exhausting stale air through the door 130.

As an alternative to placing a ventilator assembly in a door or in a transom area, a ventilator assembly may be placed vertically in a door side light area or adjacent to a door, or where desired.

In FIG. 5, a ventilator assembly 170 is schematically illustrated in dotted line adjacent to the door 150 in the structure 126 and in a vertical orientation.

The air flow through the ventilator assembly 170 is horizontal, as with the ventilator assemblies 38 and 140. The ventilator assembly 170, like the ventilator assembly 140, has the advantage of being pre-wired in new construction, or to be direct hard wired for remodeling existing structures.

If desired, one assembly 170 may be inserted into each door side light, one assembly for bringing fresh air into a structure, and a second assembly 170 for exhausting stale inside air out of the structure.

Figure 6:
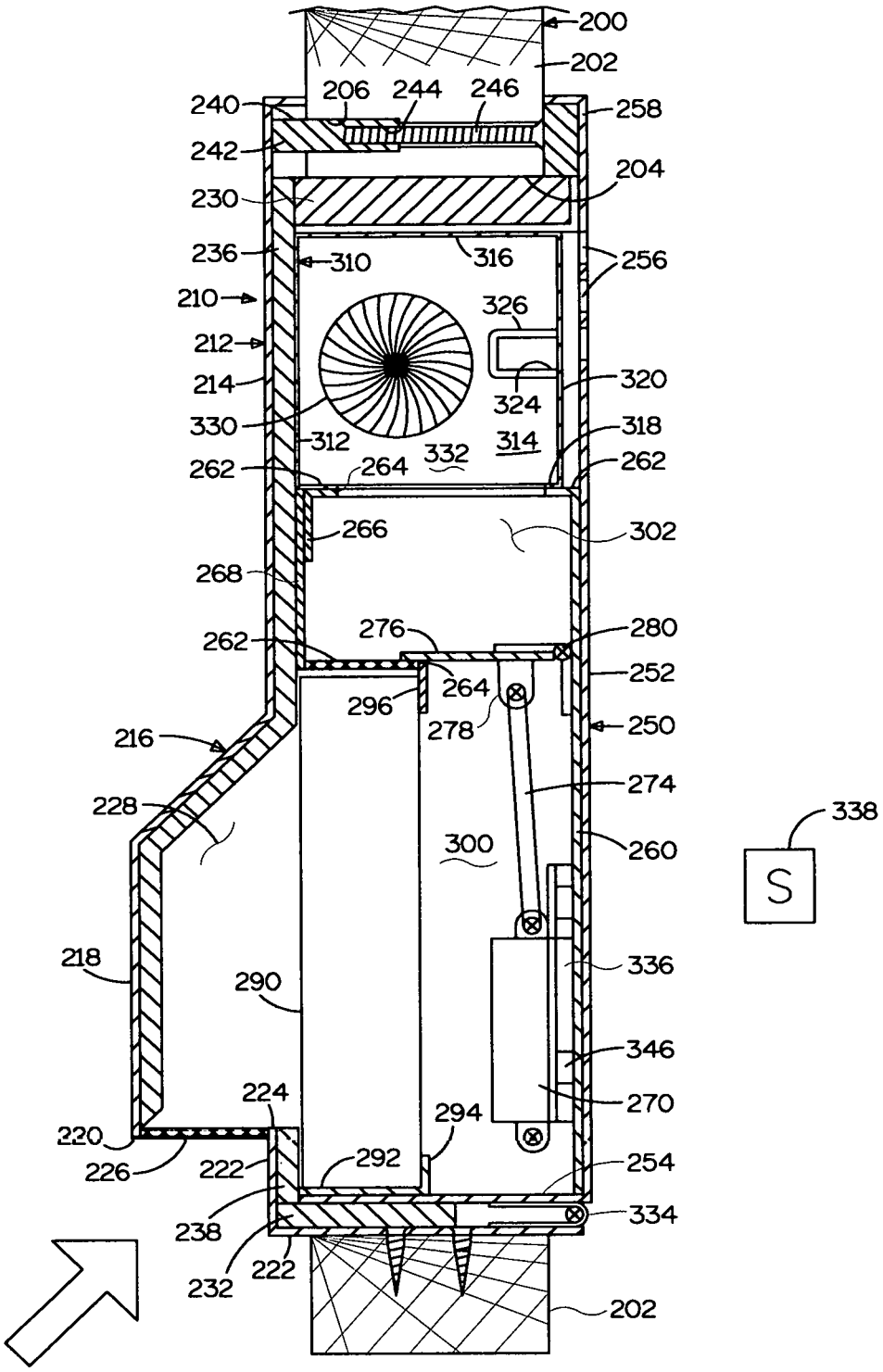
FIG. 6 is a side view in partial section through a portion of a door illustrating a pivoting assembly of the present invention.

FIG. 6 is a view in partial section through the lower portion of an exterior ventilator door 200, and specifically through a bottom rail 202 of the door 200. The bottom rail 202 includes an opening 204. A ventilator assembly 210 is disposed in the opening 204.

The ventilator assembly 210 includes a housing 212. The outside portion of the ventilator housing 212 includes an upper housing portion 214, a outwardly and downwardly or bump out portion 216, and a lower vertical portion 218. The lower vertical portion terminates at a bottom rim 220. Spaced apart from the lower vertical portion 218 is a bottom vertical portion 222. The bottom vertical portion 222 has a top rim 224. A screen 226 extends between the rims 220 and 224. An air intake chamber 228 is defined within the housing portions 216, 218, and 222. The screen 226 closes the bottom of the chamber 228.

The ventilator assembly 210 includes an upper block 230 and a lower block 232. The blocks 230 and 232 are appropriately secured to the bottom rail 202.

Insulation 236 is shown disposed between the ventilator housing 212 and the blocks 230 and 232. More will be discussed about the insulation 236 below.

The upper assembly housing portion 214 is secured to the bottom rail 202 A plurality of stepped bores 206 extend through the bottom rail 202 above the block 230. The ventilator assembly is secured to the door 200 at the bottom rail 202 by a lock assembly 240. The lock assembly 240 includes a block 242, which extends substantially between the stiles (not shown) of the door 200. The block 242 is secured to the upper housing portion 214.

It will be understood that the ventilator assembly 210 extends between the vertical rails of the door 200, as with the doors 10 and 130 of FIGS. 1-5, as best illustrated in FIG. 3. Accordingly, the housing 212 will be secured along the width of the door 200 by the lock assembly 240. There are a plurality of stepped bores 206 in the bottom rail 202. The block 242 is secured to the outside upper housing portion 214 and extends the width of the door 200 between the stiles (not shown) and a plurality of screws 246 extend into a plurality of internally tapped bores 244 in the block 242 to secure the ventilator housing 212 to the ventilator door 200 at the bottom rail 202.

A pivoting assembly 250 includes an inside skin 252. The inside skin 252 includes a bottom portion 254. At the upper portion of the skin 252 are openings 256 through which it flows outwardly from the ventilator assembly 210 and thus from the ventilator door 200.

A block 258 is secured to the inside skin 252 and is disposed against the lower rail 202 and covers the head of the screw 246 when the pivoting assembly 250 is in its closed position as shown in FIG. 6.

An inside vertical panel 260 is disposed against the skin 252. The panel 260 includes a horizontal portion 262 and a downwardly extending flange 266. An opening 264 extends through the horizontal portion 262.

Figure 7:
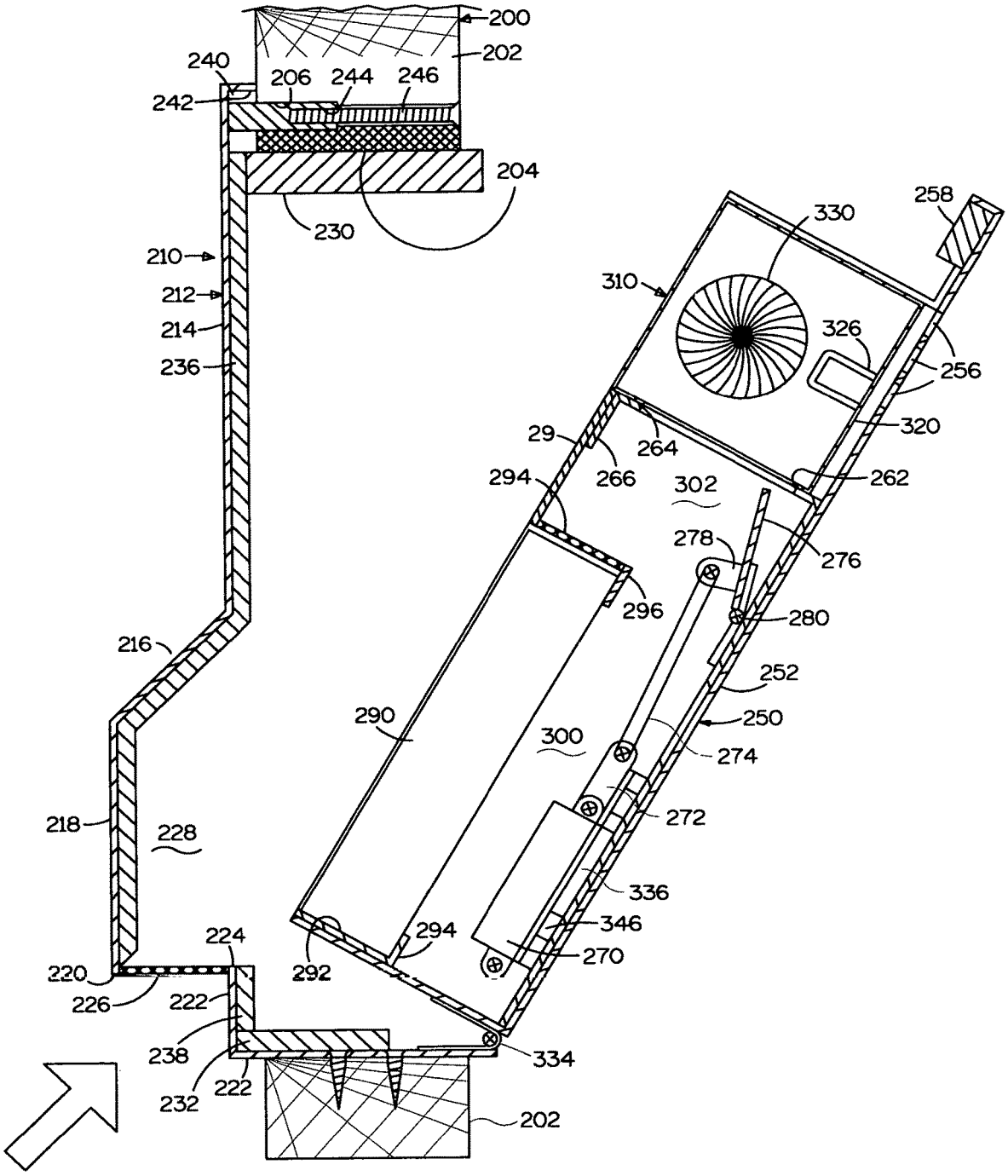
FIG. 7 is a side view in partial section of the portion of the door of FIG. 6 showing the assembly pivoting outwardly from the door.

Secured to the panel 260 is an actuator 270. The actuator 270 includes a piston rod 272 and a pivoting actuator rod 274 is connected to the piston rod 272. The pivoting rod 274 is in turn connected to a damper 276 through a damper lug 278. The actuator rod 274 pivots on the piston rod 272 and the damper lug 278 as it moves the damper 276 between the closed position covering the opening 264 shown in FIG. 6 and an open position as shown in FIG. 7.

The damper 276 controls the flow of air through the opening 264 as the damper 276 is moved by the actuator 270. The damper 276 pivots on a damper hinge 280.

A filter 290 is secured in the ventilator assembly 210 by a bottom frame element 292 and a top frame element 296. The bottom frame element is secured to the bottom portion 254 of the inside skin 252. The top frame element 296 is secured to the horizontal portion 262. The filter 290 may be a HEPA filter or a MERVE filter, or other, as desired.

As the pivoting assembly 250 pivots outwardly, the filter 290 is accessible for removing and reinserting. This is clearly shown in FIG. 7.

A fan housing 310 is disposed in the upper portion of the pivoting assembly 250. The fan housing 310 is generally rectangular and includes a back wall 312, a pair of side walls 314, only one of which is shown, a top wall 316, a bottom wall 318, which bottom wall includes an opening 320, and a front wall 322. There is an opening 324 in the front wall 322 through which air flows out of the fan housing through the openings 256 in the inside skin 252.

A restrictor element 326 is secured to the front wall 322 to control the flow of air from the fan housing 310 to insure that the flow of air flows outwardly from the door 200 through the opening 324.

Air flow is produced by a fan or blower 330. The fan 330 may be a variable speed fan or a constant speed fan, or a multiple speed fan, as desired.

The flow of air through the pivoting assembly 250 is inwardly through the screen 226 into the intake chamber 228. From the chamber 228 the air flows through the filter 290 into a lower chamber 300 and through the opening 264 as controlled by the damper 276. A middle chamber 302 receives the air flow from the lower chamber 300. From the middle chamber 302 the air flows through the opening 264 into a fan chamber 332 and then outwardly through the opening 324 and the openings 256 out of the ventilator assembly 210 and outwardly from the ventilator door 200 and into a structure to which the door 200 is secured.

The fan 330 produces the air flow into, through, and outwardly under appropriate computer control, well known and understood. A housing 346 containing the appropriate and necessary associated electronic control elements are schematically shown secured to the inside plate 260 and the actuator 270. Appropriate control signals from the electronic elements in the housing 336 are transmitted to the actuator 270 for controlling the damper position and for controlling the fan 330.

A sensor 338 senses desired information, such as temperature, humidity, carbon monoxide, particulates, and any other information relative to the functioning of the actuator 270 and the damper 276. The desired information is transmitted to the circuitry in the housing 336 to control the movement of the damper 276 and the fan 330. Movement of the damper 276 controls the actuation of the fan 330. When the damper 276 is closed, preventing air from flowing into the door, the fan 330 is off. When the damper opens, the fan turns on to provide the necessary flow of air. The sensor 338 may be located as desired for sensing the desired information for controlling the air flow through the door 200. Current technology is well adapted and understood for implementing the control of the elements discussed herein.

The pivoting assembly 250 pivots on a hinge 334 appropriately secured to the bottom rail 202 and the bottom portion 254 of the inside skin 252. The pivoting may be manual, or by means of a motor, not shown, but well known and understood. The pivoting is in response to the need to replace or clean the filter 290.

Figure 8:
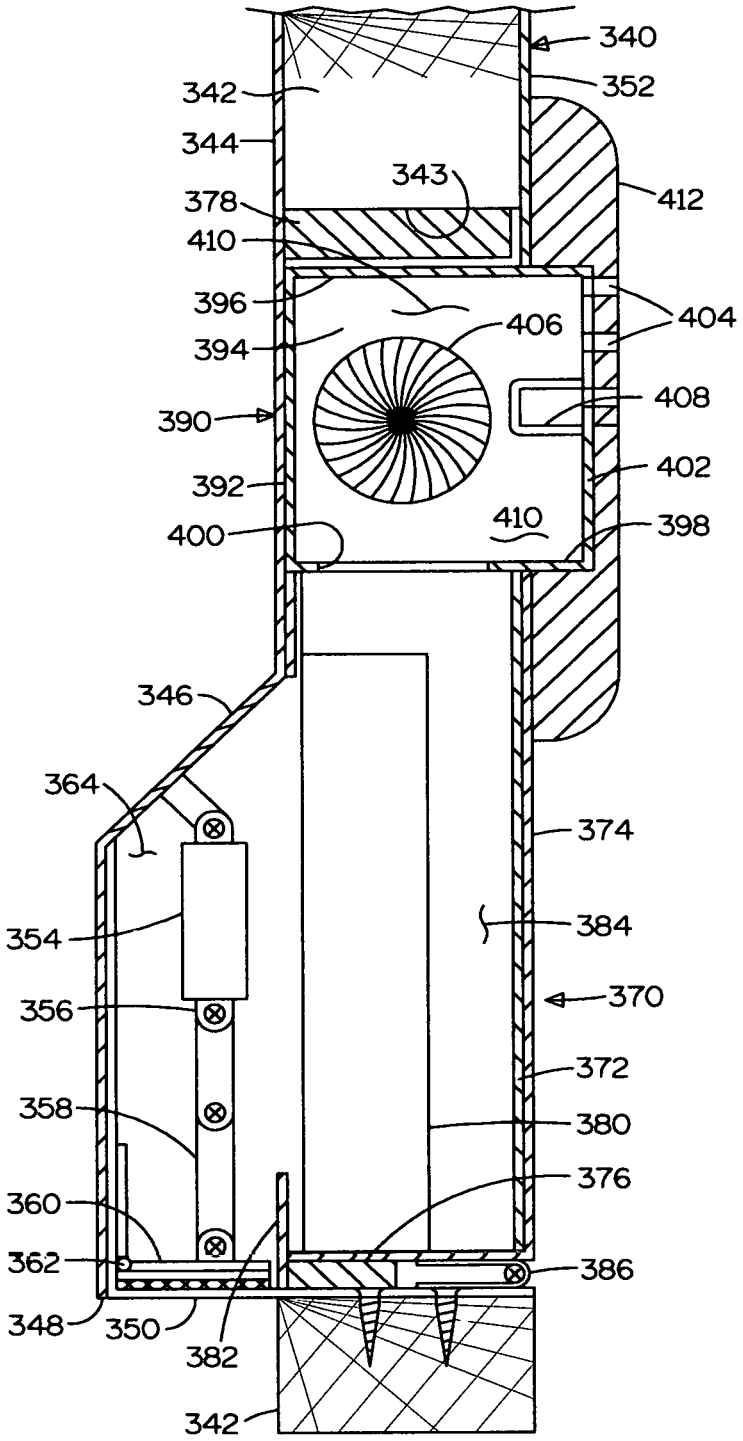
FIG. 8 is a side view in partial section showing an alternate embodiment of the assembly illustrated in FIG. 6.

FIG. 8 is a side view in partial section through an exterior ventilator door 340 similar to the door 200 of FIGS. 6 and 7. The door 340 includes a bottom rail 342 with an opening 343 through which a pivoting ventilator assembly 370 extends. The door 340 and the ventilator assembly 370 comprise an alternate embodiment of the door 200 and its ventilator assembly 210.

The door 340 includes an outside skin 344. The outside skin 344 includes a bump out portion 346. The bump out portion 346 extends downwardly and outwardly for a relatively short distance and then extends vertically downwardly and terminates at a bottom 348. A screened bottom opening 350 extends between the bottom 348 and a filter support 382. The filter support 382 is secured to a lower block 376. The block 376 is in turn appropriately secured to the bottom rail 342 at in the opening 343. The bump out portion with the screened opening defines an air intake chamber 362. Air flow through the screened opening 350 is controlled by a damper 360.

An actuator 354 is secured to the outside skin 344 at the bump out portion 346. The actuator 354 includes a piston rod 356 and a pivoting actuator rod 358. The actuator rod is pivotly connected to the piston rod 356. The actuator rod 358 is also pivotly connected to a damper 360. The damper 360 is one leaf of a hinge 362.

The hinge 362 is appropriately secured to the skin 346.

Movement of the damper 360 is accomplished by the actuator 354 to control the flow of air into the intake chamber 364.

The pivoting assembly 370 is pivotly secured to the bottom rail 342 through a hinge 416 to provide access to a filter 380. Air flows through the filter 380 and into an air chamber 384. It will be understood that the "filter" 380 may be a single filter or two filters, such a HEPA filter and a MERVE filter, or other, as desired.

The pivoting assembly 370 includes a frame 372, and secured to the frame 372 is an inside skin 374. The skin 374 is a continuation of the inside skin 352 on the door 340. The frame 372 is secured to the bottom rail 342 through a hinge 416.

Secured to the frame 372 is a fan housing 390. The fan housing includes a back wall 392, a pair of side walls 394, of which only a single side wall is shown, a top wall 396 which is spaced apart from an upper block 378. The upper block 378 is appropriately secured to the bottom rail 342 in the opening 343.

The fan housing 390 also includes a bottom wall 398. An opening 400 extends through the bottom wall 398 to allow air flow from the air chamber 384 into the fan housing 390 and into a fan chamber 410.

The fan housing 390 also includes a front wall 402. A plurality of openings extend through the front wall 402 and are aligned with openings in an upper decorative element 412.

Within the fan housing 390 is a fan or blower 406. A restrictor element 408 directs air flow through the aligned openings 404 in the front wall 402 and in the decorative element 412.

Air flow through the ventilator assembly 370 is provided by the fan 406. Air enters through the screened opening 350 and flows into the intake chamber 364 and from the chamber 364 through the filter 380 and into the air chamber 384. From the air chamber 384 the air flows through the opening 400 into the fan chamber 410 and then outwardly through the openings 404 in the front wall 402, and through the openings in the decorative element 414 aligned with the openings 404, and outwardly from the door 340.

The primary difference between the doors 200 and 340 is in the location of the actuators and thus the structure of the pivoting assemblies. The pivoting movement is the same, based on hinged action to provide access to filters within the ventilator assemblies. Moreover, the actuator 354 may be controlled by the same circuitry and sensor element(s) 338 for the door 200, as discussed above.

Figure 9:
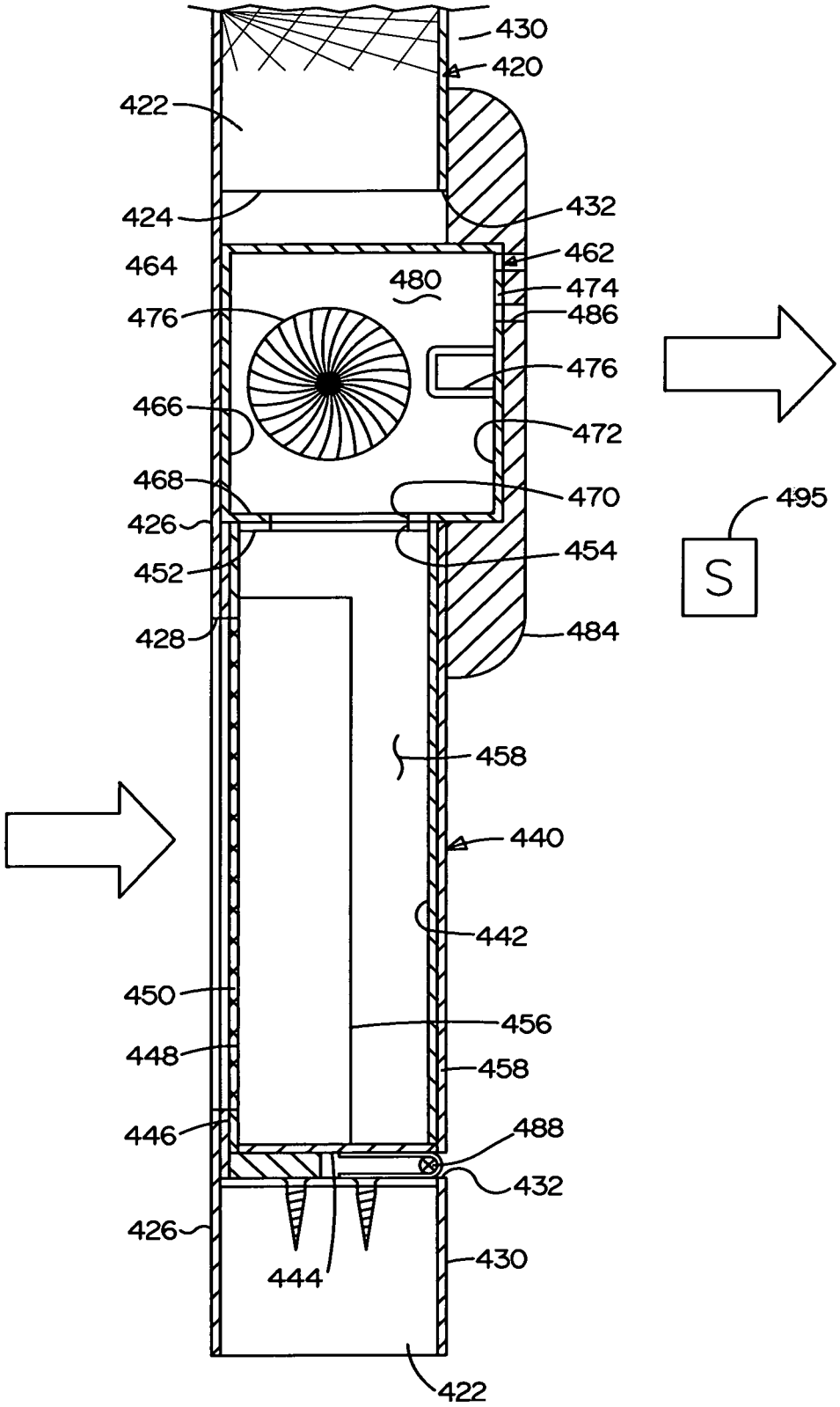
FIG. 9 is a side view in partial section of another alternate embodiment of the door of FIG. 6
Figure 10:
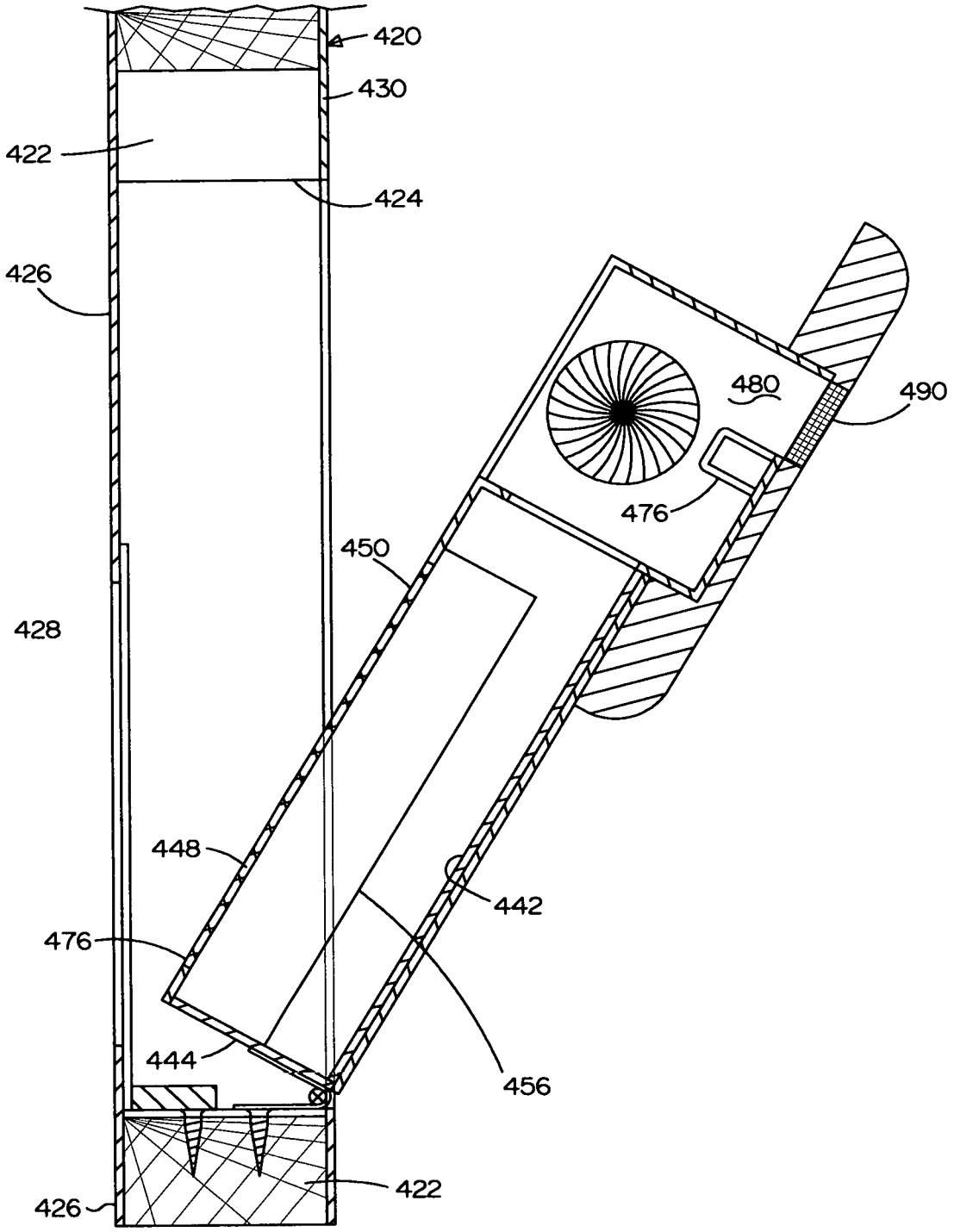
FIG. 10 is a side view in partial section illustrating the pivoting of the assembly of the door of FIG. 9.

FIG. 9 is a view in partial section of an interior ventilator door 420. FIG. 10 is a view in partial section of the door 420 of FIG. 9 sequentially following FIG. 9 showing the pivoting of an assembly 440. For the following discussion, attention may be directed to both FIGS. 9 and 10.

The door 420 includes a bottom rail 422 which has an opening 424 extending through the rail. The door 420 also has an outside skin 426. The outside skin 426 has an opening 428.

The door 420 also has an inside skin 430. An opening 432 extends through the inside skin 430.

The pivoting assembly 440 is pivotly disposed in the opening 432. The pivoting assembly 440 includes a pivoting frame, including a front wall 442, a bottom wall 444, which includes filter frame elements. The pivoting frame also includes a rear wall 446, and the rear wall has an opening 448. A screen or grill 450 is disposed in the opening 448. Air flow into the pivoting ventilator assembly is through the screen or grill 450.

The opening 448 is aligned with the opening 428 in the outer skin 426. A top frame wall 452 completes the pivoting frame. The top frame wall includes an opening 454.

A ventilator skin 460 is secured to the front frame member 452. The skin 460 is aligned with and matches the inside skin 430.

A filter 456 is disposed in the filter frame portion of the bottom wall 446.

An air intake chamber 458 is defined between the filter 456 the bottom frame wall 444, the front frame member 442 with the ventilator skin 460, and the top frame member 452.

A fan housing 462 is disposed above and appropriately secured to the pivoting frame. The fan housing 462 includes a top wall 464, a back wall 466, a bottom wall 468 with an opening 470 aligned with the opening 454 in the frame top member 452. The fan housing also includes a front wall 472 with a plurality of openings 474 extending through the wall. An air flow restrictor 476 is also secured to the front wall 472.

Within the fan housing 462 is fan 478. The flow restrictor 476 directs the air flow from the fan through the openings 474.

A fan chamber 480 is defined within the fan housing 462. The air flow through the pivoting ventilator assembly 440 begins with air flowing through the screen or grill 450 into the air intake chamber 458. From the air intake chamber 458 air flows through the aligned openings 454 and 470 into the fan chamber 480. The fan 478 provides the flow of air and sends the air flow out of the assembly 440 and the door 420 through the aligned openings 474 and 486.

The pivoting assembly 440 pivots on a hinge 488, one leaf of which is appropriately secured to the bottom rail 422 and the other leaf to the bottom wall 444.

There is no actuator and damper in the door 420. A sensor 495, corresponding to the sensors 120, 160, and 338, receives desired information, processes the information and controls the actuation of the fan 476, as may be understood from above discussions. While no circuitry housing has been shown in either FIG. 9 or FIG. 10, such may be located as desired in the door 420.

Electronic and related elements are not shown in FIGS. 9 and 10, but it will be understood that they will be as discussed for the fans of the doors 10, 130, and 200.

Again, the pivoting of the assembly 440 may be manual or by a motor, as desired. The pivoting of the assembly 440 provides access to the filter 456. And again, the "filter" may be a single filter or a pair of filters, including a pair from such as a HEPA filter, a MERVE 17 filter, a charcoal filter, or as desired, and as will fit in the thickness of the door 420

For conditioning the air flowing inwardly through the door, a heat transfer element, such as the heat sink element 58 in the door 10, may be used. The decorative elements 412 and 484 are ideal structures for including a heat sink element, such as heat sink 490 shown in FIG. 10, for conditioning the flowing air flowing through the door 420. Large arrows in FIG. 9 illustrate air flow through the pivoting assembly 440.

The heat sink 58 has been referred to as an aluminum honeycomb heat sink. It will be obvious that any appropriate material may be used for a heat sink. Thus, the heat sinks 58, 148, and 490 may be made of any appropriate material, such as aluminum, copper, ceramic, or other, as desired.

The chambers 228, 300, 302, 332, 364, 384, 410, 458, and 480 define passages through their respective doors through which air flows. The air flows are somewhat serpentine into the doors, through the pivoting assemblies and outwardly through the doors.

While the pivoting assembly elements are illustrated as being located in the bottom rail, they may also located in the top rail, if desired, or in any other convenient location in a door.

The discussion above in the specification stresses HEPA and MERVE 17 filters because of tightening standards for air quality for interior doors. Obviously the type of filter used depends on the desires of the owner of the structure in which the apparatus of the present invention is installed and other factors.

It will be noted that the door 420 of FIGS. 9 and 10 may be installed in an interior room with a forced air system, and the door may be appropriately sealed for maximum filtering of the air out of the room. Both the forced air system and the fan 476 may be required to provide the required air flow through the filter or filters and through the door and keep the pressure in the room less than three pascals It will be understood that the ventilator assemblies for the doors 10, 200, 340, and 420 preferably extend substantially the full width of the doors to maximize the air flow through the doors.

While tilting dampers have been illustrated and discussed, slide dampers may also be used, as desired.

As mentioned above in conjunction with the door 200, sensors may be located as desired for the doors 340 and 420. As technology and air standards change, the information sensing requirements may also change, along with appropriate changes in door structures, fan timing and other *desiderata*. As stated above with respect to the sensor 338, temperature, humidity, carbon monoxide, and particulates, are typically being sensed. In addition, carbon dioxide, VOCs, radon, and other gases and particulates may also be sensed, as desired. The only limitation to the sensing is the available technology.

The above described doors are exterior doors for bringing and filtering outside fresh air into a structure. As stated, the door 410 may also be used as an inside door However, the door 500 is designated as an interior ventilator door for filtering indoor air from a room as the air flows out of a room, Typically, the air will flow to a common receiving or return space for a forced air system, such as a hallway. The return air space is connected to the air return of a forced air system. With a plurality of doors 500, all receiving filtered air from rooms, the entire structure will be provided with purified air. The time required for such to occur will vary, of course, depending on obvious variables.

Figure 11:
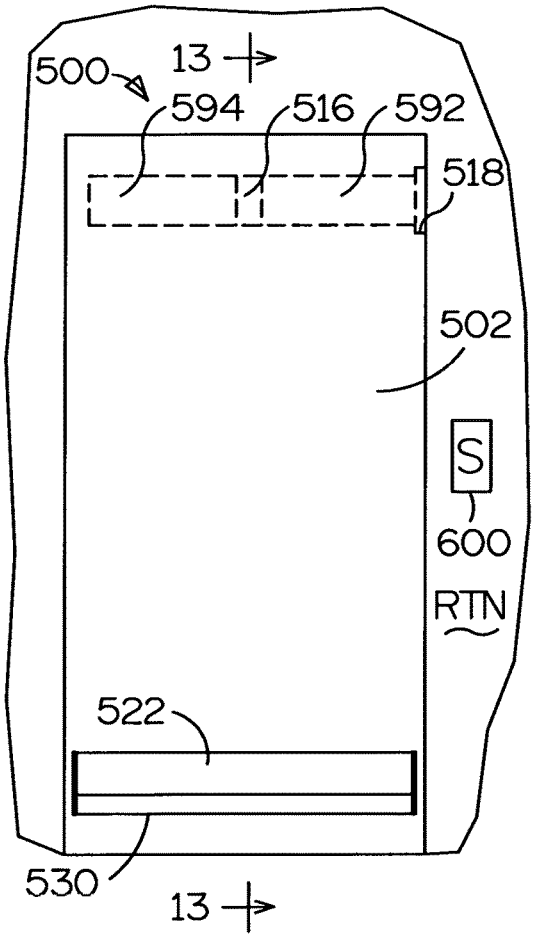
FIG. 11 is a rear, or outside, view of a door 500 of the present invention.

The definitions given above for "inside" and "outside" are different with the door 500 than as given above for the structure of FIGS. 1-10. The door 500 is an inside door and it is the "inside" air in a room that is filtered, and the filtered air is then delivered to the "outside" of a room in a structure, such as a home or apartment. FIG. 11 is plan view of the door 500 as viewed from a hall or a return air space RTN. That is, the filtered air flowing through door 500 is delivered to the return air space RTN from a housing 522 through a bottom opening 530 of the door 500.

Figure 12:
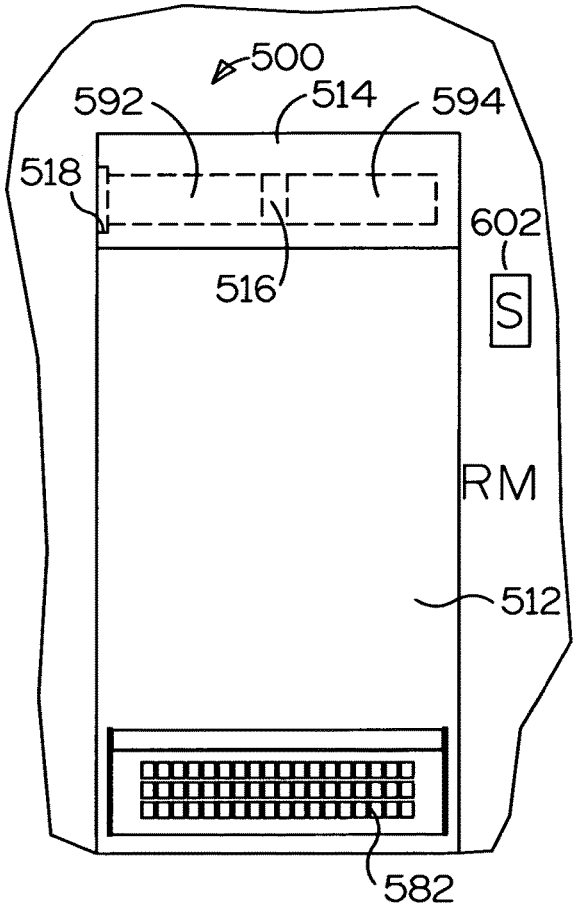
FIG. 12 is an inside, or front, view of the door 500 of FIG. 11.
Figure 13:
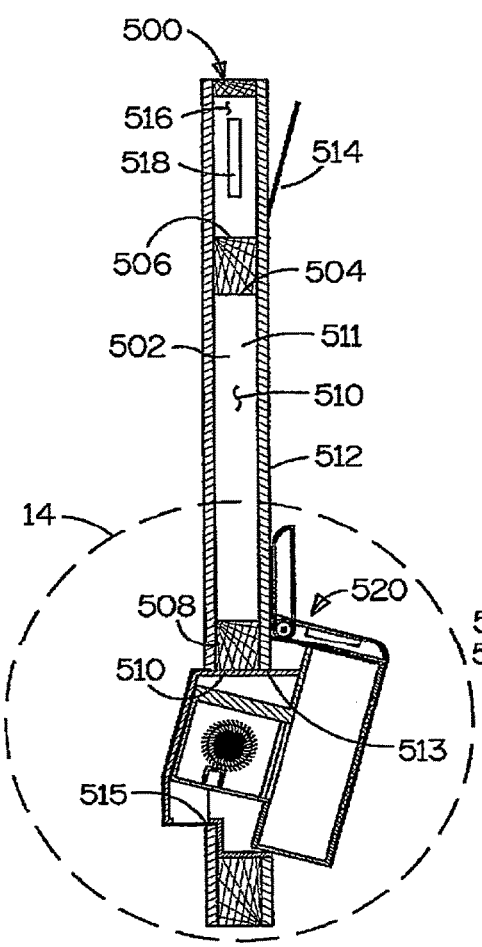
FIG. 13 is a view in partial section of the door 500 taken generally along line 13-13 of FIG. 12.
Figure 14:
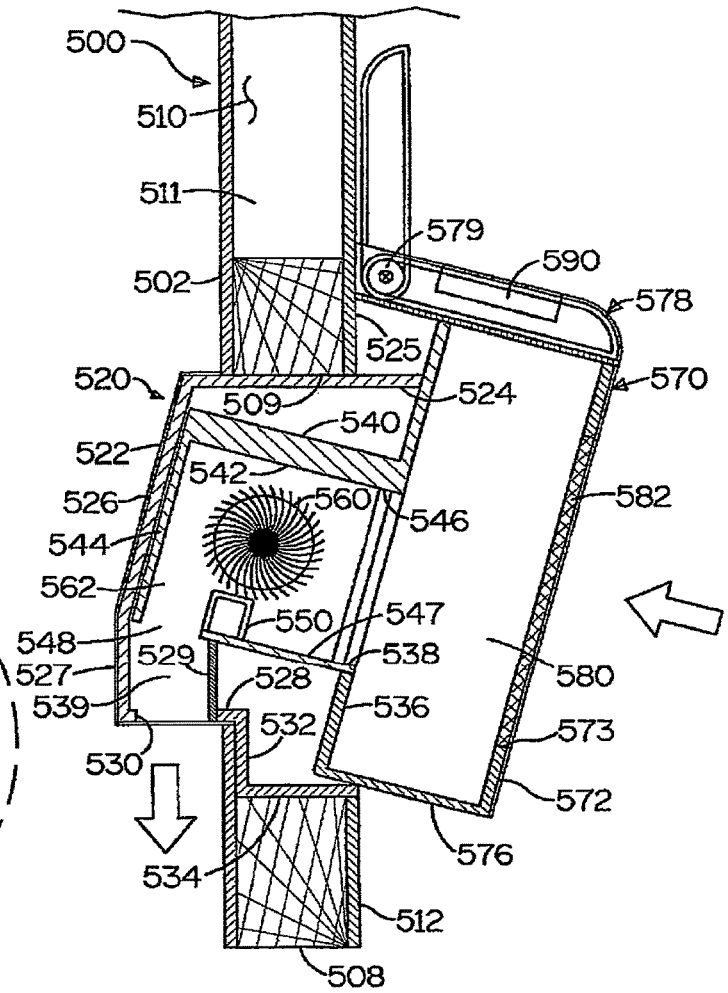
FIG. 14 is an enlarged view in partial section taken generally from circle 14 of FIG. 13.

FIG. 12 is plan view of the door 500 from the inside of a room RM. FIG. 13 is a view in partial section taken generally along line 13-13 of FIG. 11. FIG. 14 is an enlarged view in partial section taken generally from Circle 14 of FIG. 13. For the following discussion, reference may be made to FIGS. 11, 12, 13, and 14 in general, and as specifically referred to.

The door 500 is a typical interior hollow core door having a stile and rail frame, including a pair of spaced apart rails, of which a top rail 504 is shown in FIG. 13, and bottom rail 508 is shown in FIGS. 13 and 14. The door 500 also includes a pair of space apart stiles, one of which, a stile 511, is shown in FIGS. 13 and 14. The door 500 includes an outside panel or skin 502 and an inside panel or skin 512. The skins or panels 502 and 512 are appropriately secured to the also appropriately secured together stiles and rails which comprise the frame.

In FIGS. 11 and 12, a chamber 516 is shown in the top rail 504. The chamber 516 extends between the skins or panels 502 and 512, and is closed by a pivoting door 514. The pivoting door 514 provides access to the chamber 516.

At one end of the chamber 516 us a recess 518. These elements will be discussed in detail below.

Referring primarily to FIG. 14, the air purifier assembly 520 includes an outer housing 522. The outer housing 522 includes a top 524 which extends into an opening 510 into the bottom rail 508. The top 524 is disposed against the top of the opening 510 in the rail 508. The top 524 includes a vertically extending flange 525. The vertically extending flange 525 is disposed between the bottom rail 508 and the inside skin 512, and is appropriately secured there. In FIG. 13 the inside skin 512 of the door 500 includes an inside opening 513, and the outside skin 502 includes an outside opening 515.

The outer housing 522 also includes a slanted front panel portion 526 and vertically extending front panel portion 527. A bottom panel 528 extend horizontally inwardly from the panel portion 527. An opening 530 extends through the panel 528. Filtered air flows through the opening 530 into the return air space RTN.

A vertical portion 532 extends downwardly from the bottom flange 528 and is disposed against the skin 502. A bottom flange portion 534 extends horizontally from the flange 532 and is disposed against the bottom of the opening 509 in the rail 508.

Finally, the outer housing 522 includes a slanted rear panel portion 536 which is generally parallel to the slanted front panel portion 526. The slanted rear panel portion 536 extends to the top panel portion 524, and terminates slightly above the panel portion 524. An opening 538 extends through the slanted rear panel portion 536. Filtered air flows through the opening 538. The outer housing 522 also includes a pair of end portions 539, a portion of which is shown in FIG. 14. The various portions of the outer housing 522 are appropriately secured together.

A fan housing 540 is disposed in the outer housing 522. The fan housing 540 includes a top wall 542, a front wall 544, a rear opening 546, and a bottom opening 548 in a bottom wall 547. In the opening 548 is an air flow restrictor 550. Within the housing 540 is a fan 560. Air flows into the fan housing 540 through the opening 546 and is directed into the fan by the restrictor 550 and flows outwardly from the fan housing 540 through the opening 548 between the walls 527 and 529 and outwardly from the housing 520 through the opening 530 and into the return air area RTN (See FIGS. 11 and 15. The fan housing 540 also includes a pair of end portions 562, one of which is shown in FIG. 14. The large open arrows in FIG. 14 show the air flow through the assembly 520.

Appropriately secured to the outer housing 522 is a filter housing 570. The filter housing 570 includes a front wall 572. An opening 573 extends through the front wall 572. The filter housing also includes a bottom wall 576 and a pair of end walls, not shown, but appropriately secured to the front wall 572 and to the bottom wall 576. An opening 573 extends through the front wall 572. A grill 582 covers the opening 573 and allows air to flow through a filter 580 in the filter housing 570, and through the opening 538 in the wall 536 of the outer housing 522, though the opening 546 in the fan housing 540, and then out from the fan housing through the opening 548 and out of the outer housing 522 through the opening 530, and into the return air space RTN (see FIGS. 11 and 15).

The filter 580 is preferably a HEPA filter The door 500 is an interior door, the thickness of which is typically less than one and one half inches, including the inside and outside skins or panels. Accordingly there is generally sufficient room to include only a single filter without the filter assembly 520 becoming too unwieldily.

The filter housing 570 includes a pivoting top 578. The pivoting top 578 is appropriately secured to the bottom rail 508 and to the inside skin 512 or to the vertical flange 525, as shown, or as desired. The pivoting top 578 pivots on a pivot pin 579.

Located in the top 578 is a display unit 590. The display unit 590 may display any desired information as will be discussed below.

The size of the filter housing 570 and the pivoting top 578 have been exaggerated for the showing of the display unit 590 in the pivoting top 578. It follows that size of the filter 580 is also exaggerated. The size of the elements of the air purifier assembly 520 will be dimensioned appropriately to match the air flow capability of the fan 560. The size or thickness of the filter 580, or filters, if such is desired, will also affect the size of the filter housing 570. Regardless, the air flow capability of the fan 560 is of primary importance. As indicated above, air flow from a forced air system will enhance the air flow produced by the fan 560. It will also be noted that the filter 580 will be appropriately sealed in the filter housing 570 and to the fan housing 540 to insure that all air flowing to the fan housing 540 flows through the filter 580.

Figure 15:
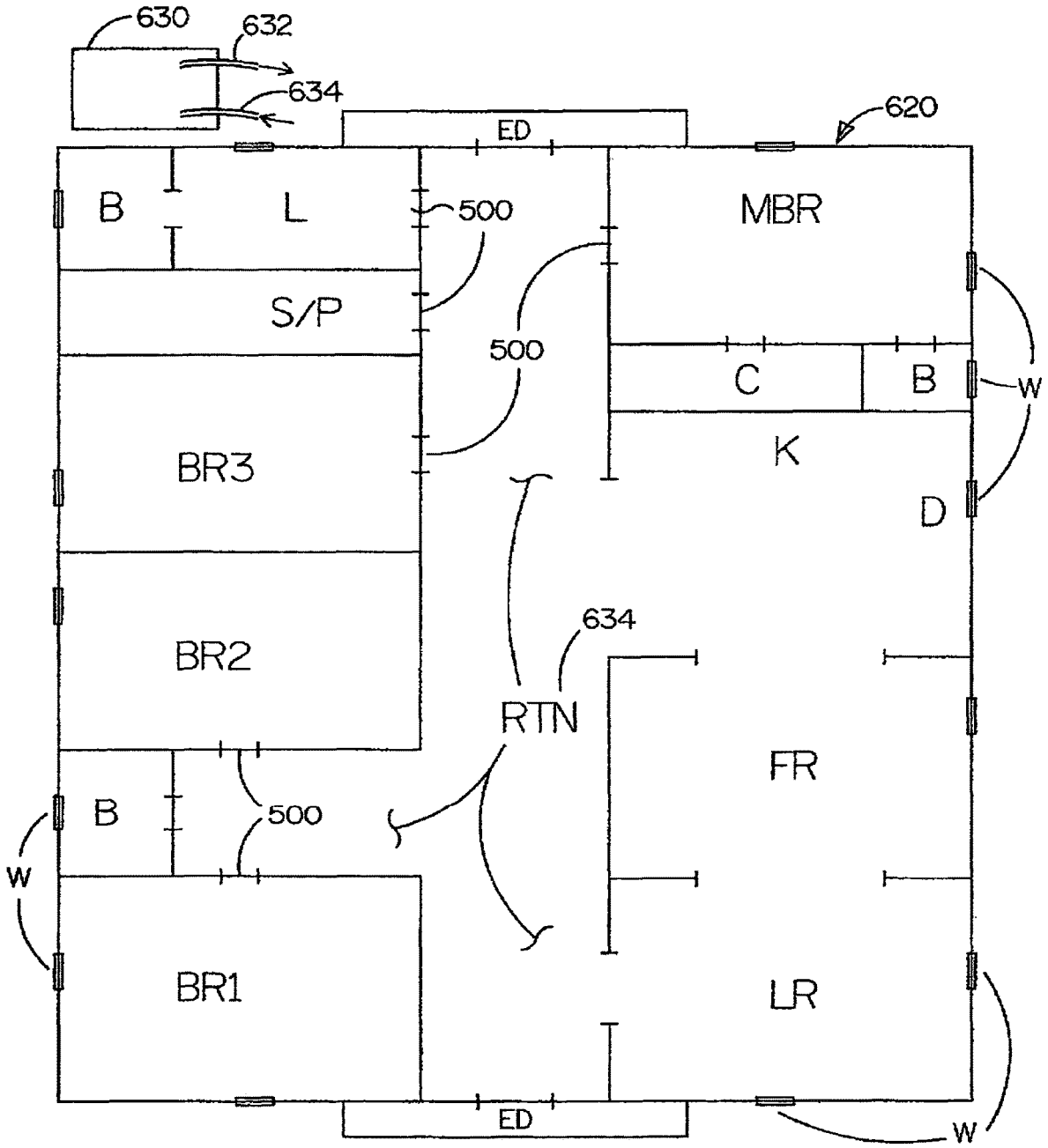
FIG. 15 is a schematic simplified diagram of a structure 600 illustrating the employment of a plurality of doors 500 for purifying the air within the structure 600.

FIG. 15 is a simplified schematic drawing of a structure 620, such a four bedroom home, including bedrooms BR1, BR2, BR3, and MBR. The structure or home 620 is illustrated as having two exterior doors ED, a plurality of windows W, a fan 560, three bathrooms B, and six doors 500. The doors 500 include one for each of the four bedrooms BR1-BR3 and MBR, one for a laundry room L. and one for a storage/pantry room S/P. The structure or home 620 also includes an open area kitchen K, dining area D, family room FR, and a living room L. Appropriate walls are shown for BR1, BR2, and BR3, the storage/pantry SIP, the laundry room L. The walls, not specified by reference numerals, combine with a wall for the master bedroom MBR, a portion of the kitchen K, the family room FR and the living room LR areas to provide a central hall return air space denoted by RTN. This is a common return air space for a forced air system 630. A small hall is defined between bedrooms BR1 and BR2. The two hall areas are connected to define the return air space RTN.

The forced air system 630 is simply illustratively of a very generic forced air system shown outside the structure or home 620. The forced air system 630 schematically illustrates a forced air duct 632 and a return air duct 643. As is well known, forced air delivery ducts terminate in registers in the various rooms and locations, of the structure or home such as the structure or home 620. Similarly, there are return air ducts typically installed in hall areas, and where ever desired, with a forced air system. Return air registers at the return ducts also typically include filters. The filters should be appropriate in keeping with the concept of the present invention.

For simplicity, there is no garage shown, and the only closet C shown is in the master bedroom MBR. FIG. 15 is illustrating the use of the doors 500 which may be employed in conjunction with a forced air system 630 for providing air purification for an entire structure. The ducts for both the forced air and the return air for recirculation are schematically shown for simplicity by reference numerals 632 and 634, respectively. They are well known and understood.

Returning to FIGS. 11 and 12, and to the chamber 516, the chamber 516 includes two portions, a portion 592 and a portion 594. The portion 592 is disposed adjacent to the recess 518. A printed circuit board (PCB), not shown, for controlling the various functions which may be included with the door 500, may be disposed in the portion 592. The recess 518 provides easy access to remove and replace a PCB.

The portion 594 may include a plurality of sensors for sensing data pertaining to a room to which the door 500 is secured. Receivers for receiving data from sensors 600 and 602 may be included in the portion 594. The sensors may also include sensors pertaining to security, such as locks on doors and windows, motion detectors located inside the structure 620, as well as outdoor sensors for security, and also weather data and air quality data from inside and outside air sensors. Sensors may also be included in the incoming forced air delivered throughout a structure, such as the home 620, for providing air quality information for the incoming air. The area 594 may also include transmitters for transmitting desired information to appropriate elements, such a locks and smart phones, and the like.

With application programing interfaces (APIs) for smart building systems, smart phones, and other contemporary technology, and contemplating continuing technology developments, many kinds of information and data may be disclosed on the display unit 590 for security and wellness purposes for the occupants of a structure, such as the structure or home 620, or apartment, with the door 500 and its associated sensors and data receivers and transmitters. Remote functions may also be accomplished, as is well known and understood with smart phones in contemporary usage. Such functions may of course may be included and accomplished with the addition of transmitters as well as receivers with the sensors 594.

Improvements are being made in technology regularly, the present invention is adaptable to advancements as they are developed. For example, the development of power over ethernet (PoE) may be ideal for apartment buildings for initial construction and also for new home construction.

The comments for the previously discussed doors pertaining to sensors and transmitters are also applicable to the door 500.

It will be noted that the air purifier assembly 520 will operate whether a door 500 is open or closed to purify or filter air as long as electric power is supplied to the fan 564. Providing power to elements in a door is well known and understood. Accordingly, electrical wiring and elements for the fan 564, the display unit 590, the portion 592, and the sensor elements and other desired elements have been omitted for clarity in the various drawing figures pertaining to the door 500 and also to FIG. 15. Likewise, elements of a forced air system are also well known and understood and have also been omitted from FIG. 15, as stated above.

It is well known that most, if not all, forced air systems have a setting where the fan or blower may operate on a 24/7 setting, with the fan or blower speed substantially reduced from when the system is operating in the heating or cooling mode. The 24/7 operation of the fan or blower is the most efficient operating for purifying the air in a structure. While operating in the 24/7 mode, the system will still go into the heating or cooling mode as required by its thermostat setting, including the desired increase in the fan or blower speed.

It will also be noted that while the air purifier assembly 520 is illustrated in the environment of a stile and rail hollow core door for convenience, the air purifier assembly 520 may be inserted in virtually any type door, hollow core, solid core, metal, or otherwise. It may be easier or more convenient to install such assembly in a hollow core door, but the assembly 520 may be retrofitted into any door by simply cutting an opening at a desired location and inserting the assembly into the opening and appropriately securing the assembly in the opening.

The location and number of sensors, with their transmitters, required or desired for a door 500 or for a plurality of doors 500 may vary depending on the specific structure and other factors, such as number of rooms, location of elements of a forced air system, and other variables.

It will be noted that the opening 516 is disposed in the top rail 504 and that the air purifier assembly 520 is disposed in the bottom rail 508. If desired the air purifier assembly may be appropriately installed as desired within the door 500. It will also be noted that the air purifier assembly 520 extends between the stiles, essentially the full width of the door 500, as with the other doors discussed above.

While HEPA filters have been discussed as preferable, obviously any filter may be used, as desired. As stated under contemporary air filtering standards, HEPA filters are preferred.

With the current "Smart" technology for cell phones, doors, and buildings, available to provide many functions associated with the present door 500, as discussed above, the next logical step is to remove noxious material from the air flow through the door 500, in addition to the particulates removed by the filters 580. The applicant has at least fourteen U.S. patents that either claim or discuss means for removing noxious material from air flowing through a door, including using uv light.

The fourteen patents include U.S. Pat. No. 9,085,933, dated Jul. 21, 2015; U.S. Pat. No. 9,109,389, dated Aug. 18, 2015; U.S. Pat. No. 9,376,856, dated Jun. 28, 2016; U.S. Pat. No. 9,493,979, dated Nov. 15, 2016, U.S. Pat. No. 9,493,980, dated Nov. 15, 2016; U.S. Pat. No. 9,719,291, dated Aug. 1, 2017; U.S. Pat. No. 9,745,793, dated Aug. 29, 2017; U.S. Pat. No. 9,803,417, dated Oct. 31, 2017; U.S. Pat. No. 10,060,182, dated Aug. 28, 2018; U.S. Pat. No. 10,156,091, dated Dec. 18, 2018; U.S. Pat. No. 10,190,360, dated Jan. 29, 2019; U.S. Pat. No. 10,190,361, dated Jan. 29, 2019; U.S. Pat. No. 10,301,869, dated May 28, 2019; and U.S. Pat. No. 11,255,121, dated Feb. 22, 2022.

While the principles of the invention have been made clear in illustrative embodiments, there will be immediately obvious to those skilled in the art many modifications of structure, arrangement, proportions, the elements, materials, and components and methods used in the practice of the invention, and otherwise, which are particularly adapted to specific environments and operative requirements, without departing from those principles. The appended claims are intended to cover and embrace any and all such modifications, within the limits only of the true spirit and scope of the invention.

What is claimed is:

1. A door for purifying air flowing from a room in a structure, comprising in combination:

an air purifier assembly secured to the door, the air purifying assembly including an outer housing, a filter housing secured to the outer housing, a filter disposed in the filter housing for purifying the air flowing through the filter;

a pivoting top on the filter housing for inserting and removing the filter;

a fan housing disposed in the outer housing and adjacent to the filter housing and receiving a flow of purified air from the filter;

a fan in the fan housing for providing the flow of purified air through the filter and outwardly from the fan housing;

an opening in the outer housing;

an inside opening in the door through which the air purifier assembly extends and including the filter housing, and through which the air flows into the filter housing;

sn outside opening in the door through which the air purifier assembly extends and through which the fitered air flows through the opening in tthe outer housing and outwardly through the door.

2. The door of claim 1 which further includes a sensor for sensing desired information, and a transmitter for transmitting the sensed desired information.

3. The door of claim 2 which further includes a display unit for displaying the desired sensed information.

4. The door of claim 3 in which the display unit is disposed in the pivoting top of the fan housing.

5. The door of claim 4 in which the door is a stile and rail door having a top rail and a bottom rail and the outer housing is disposed in the bottom rail.

6. The door of claim 5 in which the sensor is disposed in the top rail.

7. The door of claim 1 in which the door is an interior door secured to the room for purifying the air flowing out of the room.

8. The door of claim 1 which includes a plurality of sensors for sensing desired information.

9. The door of claim 8 which includes a plurality of transmitters for transmitting the sensed desired information.

10. The door of claim 8 in which the door is a stile and rail door having a top rail and a bottom rail and the plurality of the sensors includes at least one sensor disposed in the top rail and at least one sensor is disposed remotely from the door.

11. The stile and rail door of claim 10 having a top rail and a bottom rail wherein the plurality of sensors are disposed in the top rail.

12. The door of claim 1 in which the door includes a frame;

an inside panel secured to the frame;

an outside panel secured to the frame; and the inside and outside openings in the door extend through the inside and outside panels, respectively.

13. A method of purifying air in a structure comprising in combination steps of:

providing a plurality of rooms in the structure;

providing a forced air system for providing a flow of air to each room of the plurality of rooms in the structure, and for providing return air from each room of the plurality of rooms in the structure to be re-circulated;

providing a plurality of doors for the plurality of rooms in the structure for controlling a flow of return air from the plurality of rooms in the structure;

providing a return air space in the structure for receiving the flow of the return air from each door of the plurality of doors and from which the flow of the return air returns to the forced air system for re-circulation into the structure;

providing an air purifying assembly for each door of the plurality of doors in the structure, and each air purifying assembly includes an outer housing secured to each door;

providing a filter housing secured to each outer housing;

providing a filter in each filter housing for filtering the flow of return air to and through each door;

providing a fan housing in each outer housing secured to the filter housing for receiving the flow of filtered return air from the filter for each door;

providing a fan in each fan housing for assisting the flow of return air through the filter housing and through the filter for filtering the flow of return air, and for assisting the flow of return air outwardly from each room through each door to the return air space of the structure;

whereby the flow of return air is filtered, and the filtered air is re-circulated by the forced air system thereby purifying the air in the structure.

14. The method of claim 13 which includes a step of providing a pivoting lid for the filter housing for inserting and removing the filter.

15. The method of claim 14 which includes a step of providing a sensor for sensing desired information.

16. The method of claim 15 which includes a step of providing a display unit for displaying the sensed desired information.

17. The method of claim 16 which includes a step of locating the display unit in the pivoting lid.

18. The method of claim 17 which includes a step of providing a transmitter for transmitting the sensed desired information.

19. The method of claim 13 in which the plurality of doors are stile and rail doors.

* * * * *